US007299771B2

(12) United States Patent
Wei et al.

(10) Patent No.: US 7,299,771 B2
(45) Date of Patent: Nov. 27, 2007

(54) COOLANT VALVE SYSTEM FOR INTERNAL COMBUSTION ENGINE AND METHOD

(75) Inventors: Puning Wei, Naperville, IL (US); Zhengbai Liu, Naperville, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 206 days.

(21) Appl. No.: 11/330,523

(22) Filed: Jan. 12, 2006

(65) Prior Publication Data

US 2007/0157893 A1 Jul. 12, 2007

(51) Int. Cl.
*F01P 7/14* (2006.01)

(52) U.S. Cl. ..... 123/41.08; 123/41.29; 123/41.44; 123/568.12

(58) Field of Classification Search ..... 123/41.08, 123/41.29, 41.31, 41.44, 568.12
See application file for complete search history.

(56) References Cited

U.S. PATENT DOCUMENTS 7,089,890 B2 * 8/2006 Obidi ..... 123/41.31

* cited by examiner

*Primary Examiner*—Stephen K. Cronin
*Assistant Examiner*—Katrina B. Harris
(74) *Attorney, Agent, or Firm*—Jeffrey P. Calfa; Gerald W. Askew

(57) ABSTRACT

An internal combustion engine (200) includes a coolant pump (212) having a pump outlet (214), and a first exhaust gas recirculation (EGR) cooler (206) fluidly connected to the pump outlet (214). A crankcase (202) is fluidly connected in parallel with the EGR cooler (206) to the pump outlet (214) for receiving coolant therefrom. A cylinder head (204) is fluidly connected to the crankcase (202) for receiving coolant therefrom. A thermostat (232) is fluidly connected between the cylinder head (204) and the coolant pump (212). A valve system (238) has a first selectable position fluidly connecting the flow from the first EGR cooler (206) to the flow in the cylinder head (204), and a second selectable position fluidly connecting the flow from the first EGR cooler (206) to the thermostat (232) in bypassing relation to the cylinder head (204). Each of the first or second position is effected in response to an engine operating parameter.

20 Claims, 4 Drawing Sheets

- PRIOR ART -

COOLANT VALVE SYSTEM FOR INTERNAL COMBUSTION ENGINE AND METHOD

FIELD OF THE INVENTION

This invention relates to cooling systems for internal combustion engines, including but not limited to coolant control valve arrangements.

BACKGROUND OF THE INVENTION

Internal combustion engines typically use water based coolant systems for thermal management. A typical engine cooling system includes an engine driven pump for circulating coolant through the engine. The coolant is circulated through various engine components, for example, an engine crankcase, a cylinder head, one or more exhaust gas recirculation (EGR) coolers, turbocharger inter-stage coolers, and so forth. Coolant from the pump is usually cool, while coolant returning from the engine is usually hot. Heat generated by engine components, for example, combustion cylinders included in an engine crankcase, is transferred typically through conduction and/or convection to the circulating coolant.

Heat is removed from the coolant in a radiator. Before entering the radiator, the coolant passes through a thermostat which may bypass the coolant around the radiator to the pump inlet to maintain the coolant entering the engine at an elevated operating temperature by not cooling the coolant if the coolant temperature is below a predetermined value. However, since the coolant progressively accumulates heat as it passes through or over a series of engine components, sometimes circulating coolant may be at too high a temperature locally when it reaches a specific engine component, such as an EGR cooler, and may cause less than optimal performance of that component under certain operating conditions.

Accordingly, there is a need for management of coolant circuits in internal combustion engines that allows for optimal operation of various components of the engine.

SUMMARY OF THE INVENTION

An internal combustion engine includes a coolant pump having a pump outlet, and a first exhaust gas recirculation (EGR) cooler fluidly connected to the pump outlet. A crankcase is fluidly connected in parallel with the EGR cooler to the pump outlet for receiving coolant therefrom. A cylinder head is fluidly connected to the crankcase for receiving coolant therefrom. A thermostat is fluidly connected between the cylinder head and the coolant pump. A valve system has a first selectable position fluidly connecting the flow from the first EGR cooler to the flow in the cylinder head, and a second selectable position fluidly connecting the flow from the first EGR cooler to the thermostat in bypassing relation to the cylinder head. Each of the first or second position is effected in response to an engine operating parameter.

A method for operating an internal combustion engine includes the step of pumping an amount of engine coolant to form a coolant flow at an outlet of a pump. The coolant flow is split into at least one of an exhaust gas recirculation (EGR) cooler flow and an engine flow. The EGR cooler flow is passed through an EGR cooler. The engine flow is passed through at least one of a crankcase and a cylinder head. The EGR cooler flow is segregated from the engine flow selectively by a valve system. When the EGR cooler flow and the engine flow are segregated, the EGR cooler flow is recombined with the engine flow upstream of a thermostat.

Another method for operating an internal combustion engine includes the step of pumping a first coolant flow to an exhaust gas recirculation (EGR) cooler controlled by a valve system and a second coolant flow to an engine crankcase. The second coolant flow is passed to a cylinder head. When the internal combustion engine is operating at a low engine load range, the first coolant flow is routed directly to a thermostat. When the internal combustion engine is operating at a high engine load range, the first coolant flow is routed to the cylinder head. Under transient conditions, a valve system may change or switch a coolant flow path between a first and a second selectable position in response to an engine operating parameter.

DESCRIPTION OF A PREFERRED EMBODIMENT

Figure 1:
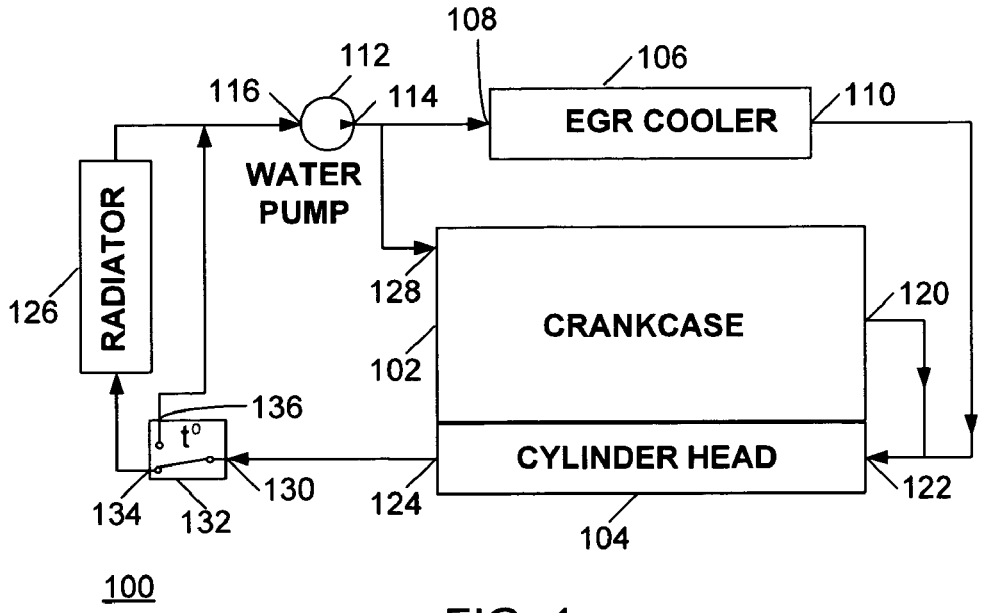
FIG. 1 is a block diagram of an internal combustion engine cooling system in accordance with the prior art.

The following describes an apparatus for and method of management of coolant circuits in internal combustion engines that allows for optimal operation of an internal combustion engine. A prior art engine coolant circuit configuration is shown in FIG. 1. An engine 100 includes a crankcase 102 connected to a cylinder head 104. An EGR cooler 106 may be connected to the crankcase 102 of the engine 100 and has an EGR cooler inlet 108 and EGR cooler outlet 110. A water pump 112 has a pump inlet 116, and a pump outlet 114. The engine cooling circuit includes a coolant inlet 128 of the crankcase 102 that is fluidly connected to the pump outlet 114. A coolant outlet 120 from the crankcase 102 may be a port, but preferably is integrated with the crankcase 102 and is embodied in a plurality of openings that fluidly communicate with corresponding openings in the cylinder head 104. For the sake of clarity, the coolant outlet 120 is illustrated as a single port communicating with an external surface of the crankcase 102 as shown. Also for clarity, a cylinder head coolant inlet port 122 and a cylinder head outlet port 124 are shown.

A radiator 126 may be disposed adjacent to the engine 100 and be configured to release heat transferred from a coolant flow to the environment. A thermostat 132 is arranged to route the coolant flow either through or around the radiator 126 depending on a temperature of the coolant flow for the purpose of maintaining a minimum operating temperature during normal engine operation, as is known in the art.

Typical connections that form a coolant circuit are described herein, but other configurations or types of coolant connections between various engine components may provide similar results. The water pump outlet 114 is further connected in a parallel circuit to the EGR cooler inlet 108 and the EGR cooler outlet 110 is connected to the cylinder head inlet 122. During operation of the engine 100, coolant flow exits the pump 112 through the outlet 114 and splits between the inlets 108 and 128. Coolant exiting the crankcase 102 mixes with coolant from the outlet 110 of the EGR cooler 106 at or in the cylinder head 104.

Coolant exiting through the cylinder head outlet 124 is typically routed to an inlet 130 of a thermostat 132. The thermostat 132 has a radiator outlet 134 and a bypass outlet 136. When a temperature of the coolant flow from the outlet 124 is below a threshold value, for example, about 190 deg. F. (88 deg. C.), then the coolant flow may be routed through the bypass outlet 136 and re-enter the inlet 116 of the pump 112. When the temperature of the coolant flow from the outlet 124 is above the threshold value, then the coolant flow may be routed through the radiator outlet 134, be cooled by passing through the radiator 126, and then re-enter the inlet 116 of the pump 112.

Water pumps are mechanically driven by an engine, typically through a belt or a direct mechanical connection by gears. When the engine 100 operates at low engine speeds, for example, engine speeds below 1500 rpm, the coolant flow at the outlet 114 is lower than it is when the engine 100 operates at higher engine speeds. Cooling requirements of the engine 100 may change according to a load on the engine 100. More internal heat is released when the engine 100 operates at high loads, above 75% of a peak load capability of the engine 100. Conversely, less internal heat is released when the engine 100 operates at low loads, around 25% of peak torque capability, or medium loads, around 50% of peak torque capability.

Figure 2:
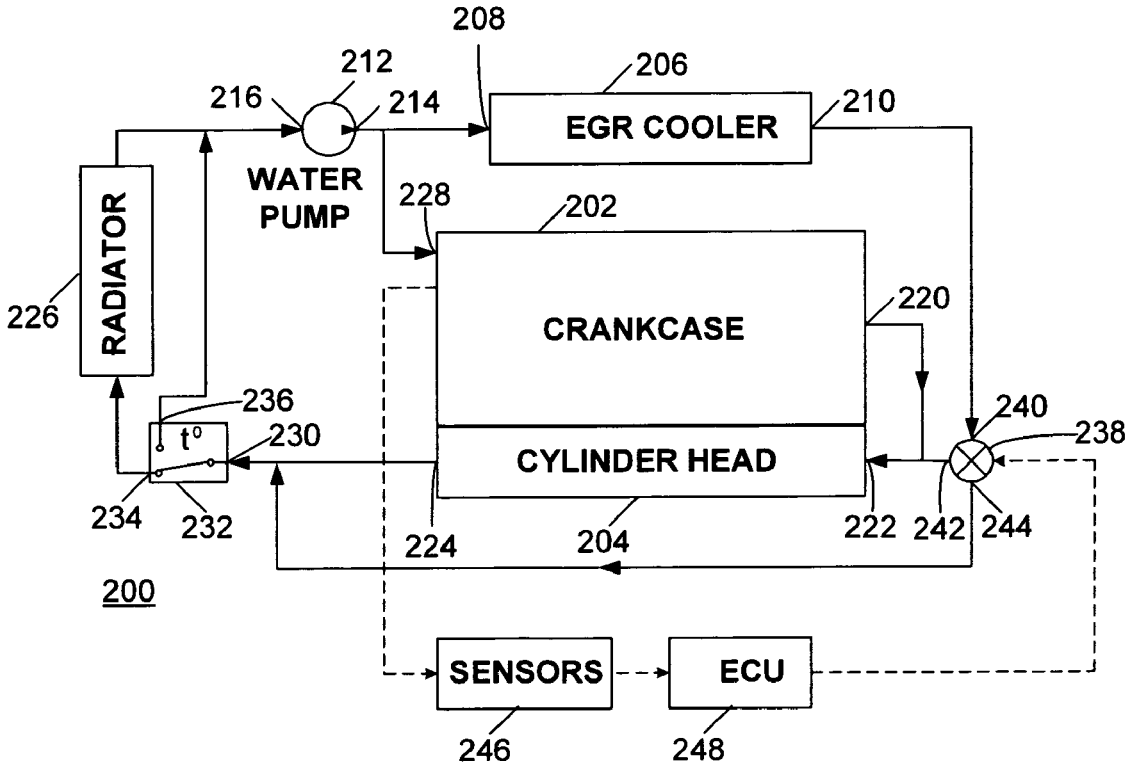
FIG. 2 is a block diagram of an internal combustion engine having a coolant control valve system in accordance with the invention.

Engine fuel economy, in general, depends in large part on energy losses during operation. One form of energy loss that affects fuel economy is energy lost in the form of heat. If an engine is not operating under high load conditions, an opportunity to optimize operation of the engine may advantageously be realized by managing the amount of heat removed from the engine. An engine 200 capable of managing heat lost during operation is shown in FIG. 2.

The engine 200 includes a crankcase 202 connected to a cylinder head 204. An EGR cooler 206 has an EGR cooler inlet 208 and EGR cooler outlet 210. A water pump 212 has a pump inlet 216, and a pump outlet 214. The crankcase 202 has a coolant inlet 228. The crankcase 202 has a coolant outlet 220. A thermostat 232 is arranged to route a coolant flow either through or around a radiator 226. The pump outlet 214 is fluidly connected in parallel to the EGR cooler inlet 208 and to the coolant inlet 228 in the crankcase 202. The crankcase coolant outlet 220 is operatively connected to inlet 222 of the cylinder head 204 preferably by a plurality of openings that fluidly communicate with corresponding openings in the cylinder head 204 and schematically represented for clarity in the drawings as inlet 222.

Coolant exiting through the cylinder head outlet 224 is typically routed to an inlet 230 of a thermostat 232. The thermostat 232 has a radiator outlet 234 and a bypass outlet 236. When a temperature of the coolant flow from the outlet 224 is below a threshold value, for example, about 190 deg. F. (88 deg. C.), then the coolant flow may be routed through the bypass outlet 236 and re-enter the inlet 216 of the pump 212. When the temperature of the coolant flow from the outlet 224 is above the threshold value, then the coolant flow may be routed through the radiator outlet 234, be cooled by passing through the radiator 226, and then re-enter the inlet 216 of the pump 212.

A coolant control valve system 238 in accordance with the invention has a diverter inlet 240, a main outlet 242, and a diverter outlet 244. The valve system 238 shown in this embodiment may be a single three-pole-single-throw electrically-operated valve arranged to route coolant from the diverter inlet 240 to one of the outlets 242 and 244. The diverter inlet 240 is connected to the outlet 210 of the EGR cooler 206. The main outlet 242 is connected to the inlet 222 of the cylinder head 204. The diverter outlet 244 is connected to the inlet 230 of the thermostat 232, bypassing the cylinder head 204.

A plurality of sensors 246 are connected to the engine 200. The plurality of sensors 246 may include an engine coolant temperature sensor, an engine oil temperature sensor, an engine crankshaft and/or camshaft position sensor, and so forth. The plurality of sensors 246 may be connected to an engine control unit (ECU) 248. The ECU 248 may receive information from the sensors 246 and compute or calculate various engine operating parameters for the engine 200 during operation. These engine operating parameters may include engine speed, engine load, and so forth. The ECU 248 may be connected to the valve system 238 and be arranged and have appropriate control strategy to command a position of the valve system 238 that enables a selection of fluidly connecting the inlet 240 of the valve system 238 with either the main outlet 242 or the diverter outlet 244 in response to engine operating conditions.

Figure 3:
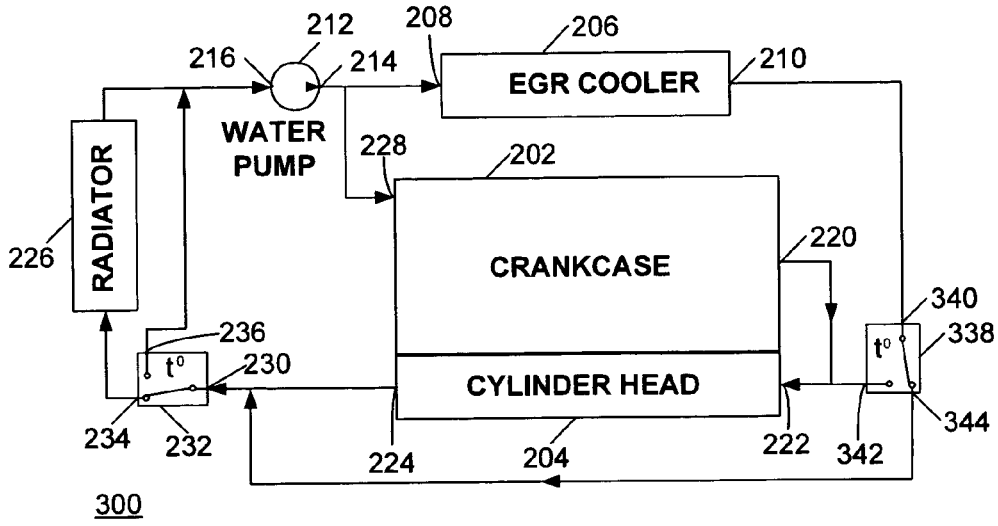
FIG. 3 is a block diagram of an internal combustion engine having an alternate embodiment for a coolant valve system in accordance with the invention.

An alternative valve system 338 for an engine 300 is shown in FIG. 3. The valve system 338 has a diverter inlet 340, a main outlet 342, and a diverter outlet 344. The valve system 338 shown in this embodiment includes a thermostat element arranged to route coolant from the inlet 340 to one of the outlets 342 and 344 in response to a temperature of the coolant entering the valve system 338 through the inlet 340. Other components included in the engine 300 are referenced by common numerals as components of the engine 200 shown in FIG. 2 if they perform the same or similar functions for the sake of brevity. The inlet 340 is connected to the outlet 210 of the EGR cooler 206. The main outlet 342 is connected to the inlet 222 of the cylinder head 204. The diverter outlet 344 is connected to the inlet 230 of the thermostat 232. In this embodiment, use of the ECU 248 for control of the valve system 338 is advantageously not required because operation of the valve system 338 relies on the operation of the thermostat element included in the valve system 338.

Figure 4:
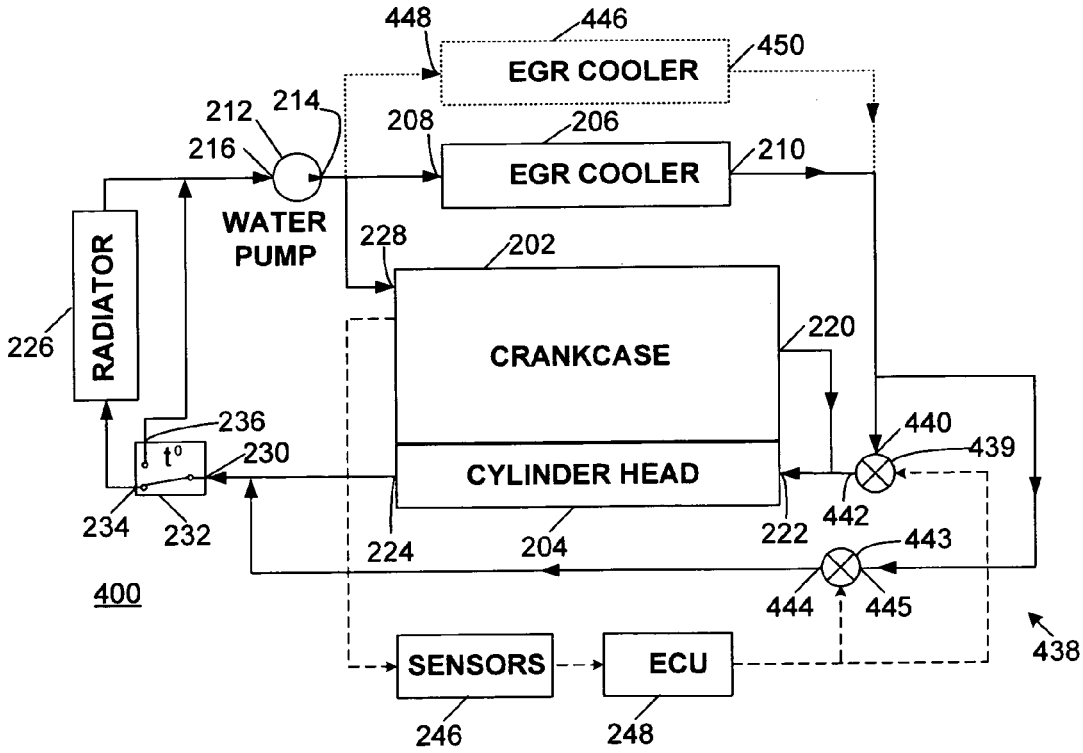
FIG. 4 is a block diagram of an internal combustion engine having a coolant control valve system and a second EGR cooler in accordance with the invention.

Another alternative valve system 438 for an engine 400 is shown in FIG. 4. The valve system 438 includes a first valve 439 having a first diverter inlet 440 and a main outlet 442. A second valve 443 has a second diverter inlet 445, and a diverter outlet 444. Each of the first valve 439 and the second valve 443 may be a single two-pole-single-throw electrically-operated valve of an on/off type. Other components included in the engine 400 are referenced by common numerals as components of the engine 200 shown in FIG. 2 if they perform the same or similar functions for the sake of brevity. The inlets 440 and 445 are both connected in parallel to the outlet 210 of the EGR cooler 206. A second EGR cooler 446 having an inlet 448 and an outlet 450 may be added to the engine 400, preferably in parallel to the EGR cooler 206. The second EGR cooler 446 is optional and may have the inlet 448 in fluid communication with the inlet 208 of the EGR cooler 206, and the outlet 450 in fluid communication with the outlet 210 of the EGR cooler 206. The main outlet 442 of the valve system 438 is connected to the inlet 222 of the cylinder head 204. The diverter outlet 444 is connected to the inlet 230 of the thermostat 232. The ECU 248 may be connected to the valve system 438 and be arranged and constructed to command a position of each of the valves 439 and 443 included in the valve system 438 that enables a selection of fluidly connecting each of the first and second diverter inlets 440 and 445 of the valve system 438 with either the outlet 442 or the outlet 444 in a fashion similar to the embodiment illustrated in FIG. 2.

Figure 5:
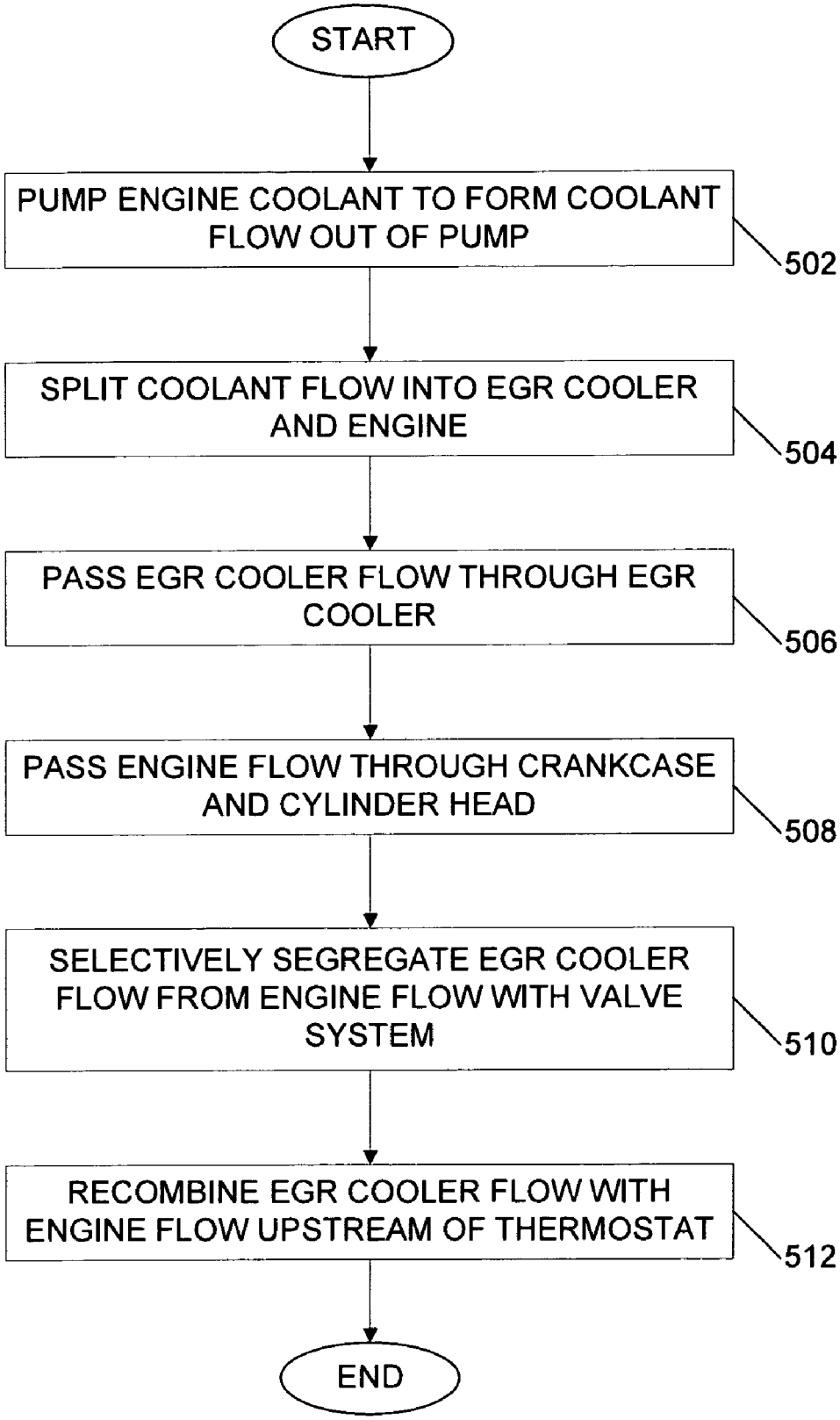
FIG. 5 is a flowchart for a method of coolant circuit management for optimal operation of an internal combustion engine in accordance with the invention.

A method of coolant circuit management for optimal operation of an internal combustion engine is shown in FIG. 5. Engine coolant is pumped by a coolant pump to form a coolant flow in step 502. The coolant pump may be driven mechanically by the engine, or alternatively may be electrically driven. The coolant flow out of the pump is split into parallel EGR cooler flow and engine flow in step 504. Parallel flow out of the pump is advantageous for the EGR cooler because coolant temperature is low at this point of the circuit. The EGR cooler flow is passed through an EGR cooler at step 506. The engine coolant flow enters a crankcase and from there enters or is passed to a cylinder head at step 508. In a typical engine configuration the EGR cooler flow is merged with the engine flow entering the cylinder head. Here, the EGR cooler flow may be selectively segregated from the engine flow entering the cylinder head by use of a valve system at step 510. The segregated EGR cooler flow and the engine flow exiting the cylinder head are recombined upstream of the radiator flow thermostat at step 512.

This method may include additional steps depending on engine configuration. For example, the coolant flow exiting the thermostat may be cooled in a radiator before being recirculated back to the pump. Additionally, an ECU may command the valve system to either segregate or combine the EGR cooler flow with the engine coolant flow depending on operating parameters of the engine, for example, engine speed and/or engine load.

Figure 6:
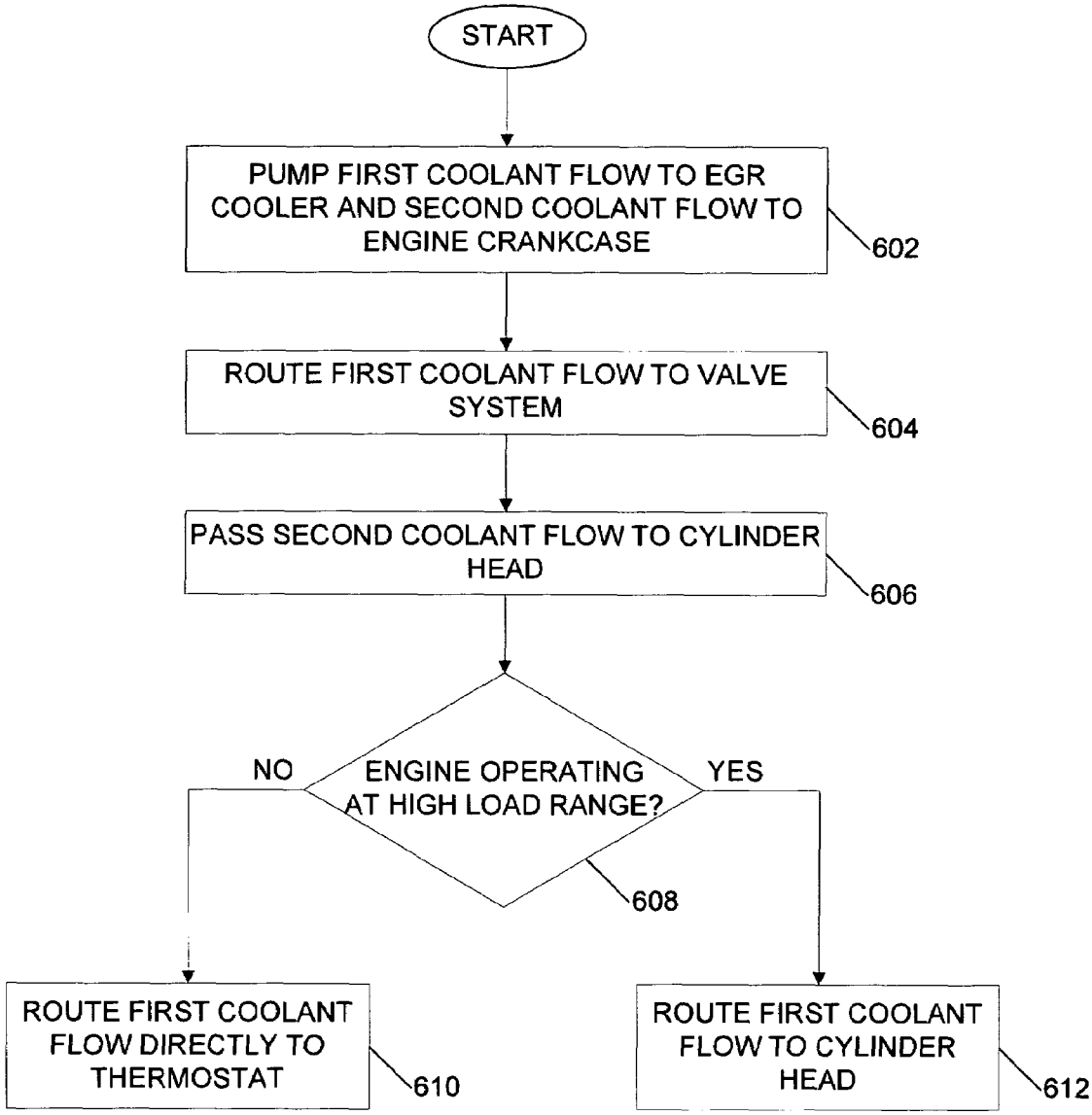
FIG. 6 is a flowchart for an alternative method of coolant circuit management for optimal operation of an internal combustion engine in accordance with the invention.

Another method of coolant circuit management for optimal operation of an internal combustion engine is shown in FIG. 6. A first coolant flow is pumped to an EGR cooler, and a second coolant flow is pumped to an engine crankcase at step 602. The first coolant flow is routed to a valve system at step 604. The second coolant flow is passed from the crankcase to a cylinder head at step 606. A decision is made based on an engine operating load range at step 608. When the engine operates at a low and/or a medium load range, the valve system routes the first coolant flow directly to a thermostat at step 610, thereby bypassing the cylinder head. When the engine operates at a high load range, the valve system routes the first coolant flow to the cylinder head where it mixes with the second coolant flow at step 612 and provides additional cooling for the cylinder head under these high load conditions.

Any of the embodiments described herein are advantageous to the operation of an internal combustion engine. Comparison data between an engine without the invention and an engine made in accordance with the invention at various conditions of steady state operation showed that fuel consumption and emissions may be decreased. For example, when the engines were compared a low speed and low load condition and the EGR coolant flow was routed directly to the thermostat, fuel consumption was decreased by 1.1%, nitrous oxides were reduced by about 12.3%, and soot was reduced by 1.3%. Under high speed and low load conditions, with the EGR cooler flow still routed directly to the thermostat, fuel consumption was decreased by 2.4%, nitrous oxides were reduced by 15.6%, and soot was reduced by 0.4%. Under medium speed and medium load conditions, fuel consumption was decreased by 0.5%, nitrous oxides were reduced by 5.4%, and soot was reduced by 1.3%, respectively.

The laboratory data above is indicative of the advantages that may be realized by the embodiments disclosed herein and their equivalents. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An internal combustion engine, comprising:

a coolant pump having a pump outlet;

a first exhaust gas recirculation (EGR) cooler fluidly connected to the pump outlet;

a crankcase fluidly connected in parallel with the EGR cooler to the pump outlet for receiving coolant therefrom;

a cylinder head fluidly connected to the crankcase for receiving coolant therefrom;

a thermostat fluidly connected between the cylinder head and the coolant pump; and a valve system having a first selectable position fluidly connecting the flow from the first EGR cooler to the flow in the cylinder head and a second selectable position fluidly connecting the flow from the first EGR cooler to the thermostat in bypassing relation to the cylinder head, said first or second position being effected in response to an engine operating parameter.

2. The internal combustion engine of claim 1, further comprising:

a plurality of sensors disposed on the engine and arranged to measure at least one engine parameter; and an electronic control unit connected to the plurality of sensors and arranged to control each selectable position of the valve system.

3. The internal combustion engine of claim 2, wherein the valve system is an electrically actuated valve.

4. The internal combustion engine of claim 1, wherein the valve system has a coolant inlet in fluid communication with the first EGR cooler, a first outlet in fluid communication with the cylinder head, and a second outlet in fluid communication with the thermostat.

5. The internal combustion engine of claim 1, wherein the valve system includes two or more two-pole-single-throw valves.

6. The internal combustion engine of claim 1, further comprising a second EGR cooler fluidly connected in a parallel configuration with the first EGR cooler.

7. The internal combustion engine of claim 1, further comprising a radiator, wherein the radiator is fluidly connected to the thermostat and the water pump.

8. A method for an internal combustion engine, comprising the steps of:

pumping an amount of engine coolant to form a coolant flow at an outlet of a pump;

splitting the coolant flow into at least one of an exhaust gas recirculation (EGR) cooler flow and an engine flow;

passing the EGR cooler flow through an EGR cooler;

passing the engine flow through at least one of a crankcase and a cylinder head;

segregating the EGR cooler flow from the engine flow selectively with a valve system; and when the EGR cooler flow and the engine flow are segregated, recombining the EGR cooler flow with the engine flow upstream of a thermostat.

9. The method of claim 8, further comprising the step of cooling the coolant flow in a radiator.

10. The method of claim 9, wherein the step of segregating is accomplished by use of an electronically controlled three-pole-single-throw valve.

11. The method of claim 9, wherein the step of segregating is accomplished by use of at least two electronically controlled two-pole-single-throw valves.

12. The method of claim 9, wherein the step of segregating is accomplished by use of a thermally controlled three-pole-single-throw thermostat.

13. The method of claim 9, wherein the step of segregating is performed when the internal combustion engine is operating under conditions of low engine torque.

14. The method of claim 8, further comprising the step of electronically commanding a position to at least one valve of the valve system.

15. The method of claim 14, wherein the electronic command is issued by an electronic control unit.

16. The method of claim 14, further comprising the steps of sensing a plurality of engine parameters using a plurality of sensors, and communicating the sensed engine parameters to an electronic control unit that is arranged and constructed to operate the valve system.

17. A method for an internal combustion engine, comprising the steps of:

pumping a first coolant flow to an exhaust gas recirculation (EGR) cooler and a second coolant flow to an engine crankcase;

routing the first coolant flow to a valve system;

passing the second coolant flow to a cylinder head;

when the internal combustion engine is operating at a low engine torque condition, routing the first coolant flow directly to a thermostat; and when the internal combustion engine is operating at a high engine torque condition, routing the first coolant flow to the cylinder head.

18. The method of claim 17, further comprising the step of passing the first coolant flow and the second coolant flow through a radiator.

19. The method of claim 17, wherein the step of routing the first coolant flow directly to a thermostat includes opening a first valve and closing a second valve.

20. The method of claim 17, wherein a determination of an engine speed range is made in an electronic control unit that receives inputs of engine parameters through a plurality of sensors disposed on the internal combustion engine.

* * * * *